US007393059B2

(12) United States Patent
Haese et al.

(10) Patent No.: US 7,393,059 B2
(45) Date of Patent: Jul. 1, 2008

(54) PLANING DEVICE AND METHOD FOR ACTIVATING A PLANNING DEVICE

(75) Inventors: Erwin Haese, Bochum (DE); Manfred Ziegler, Erftstadt (DE)

(73) Assignee: DBT GmbH (DE)

( * ) Notice: Subject to any disclaimer, the term of this patent is extended or adjusted under 35 U.S.C. 154(b) by 107 days.

(21) Appl. No.: 11/412,534

(22) Filed: Apr. 27, 2006

(65) Prior Publication Data

US 2007/0029863 A1 Feb. 8, 2007

(30) Foreign Application Priority Data

Apr. 28, 2005 (DE) ..... 10 2005 020 170

(51) Int. Cl.
*E21C 29/04* (2006.01)
*E21C 35/04* (2006.01)

(52) U.S. Cl. ..... 299/1.6

(58) Field of Classification Search ..... 299/1.6, 299/1.05

See application file for complete search history.

(56) References Cited

U.S. PATENT DOCUMENTS 4,722,574 A * 2/1988 Barham et al. ..... 299/1.05
5,343,130 A * 8/1994 Paschedag et al. ..... 318/434

FOREIGN PATENT DOCUMENTS

DE 4024830 A1 * 2/1992

OTHER PUBLICATIONS

Journal Bergbau [Mining] Jul. 2003, pp. 311-315, Germany.

* cited by examiner

*Primary Examiner*—John Kreck
(74) *Attorney, Agent, or Firm*—Baker & McKenzie LLP

(57) ABSTRACT

A planing device and a method for activating a planing device, with a mining planer reversibly moveable by means of a planer chain, with at least two chain drives having variable-speed drive motors, with a planer travel measurement system and with a motor control device which, for example by position control, delivers activation parameters for a change in rotational speed of the drive motors for changing the planing speed and which is assigned a control module 12 with automatic load compensation regulation between the drive motors. A monitoring module is provided, which, for example by position control, switches off the control module for load compensation regulation or modifies its operating mode and delivers different activation parameters to the drive motors.

19 Claims, 1 Drawing Sheet

PLANING DEVICE AND METHOD FOR ACTIVATING A PLANNING DEVICE

Figure 1:
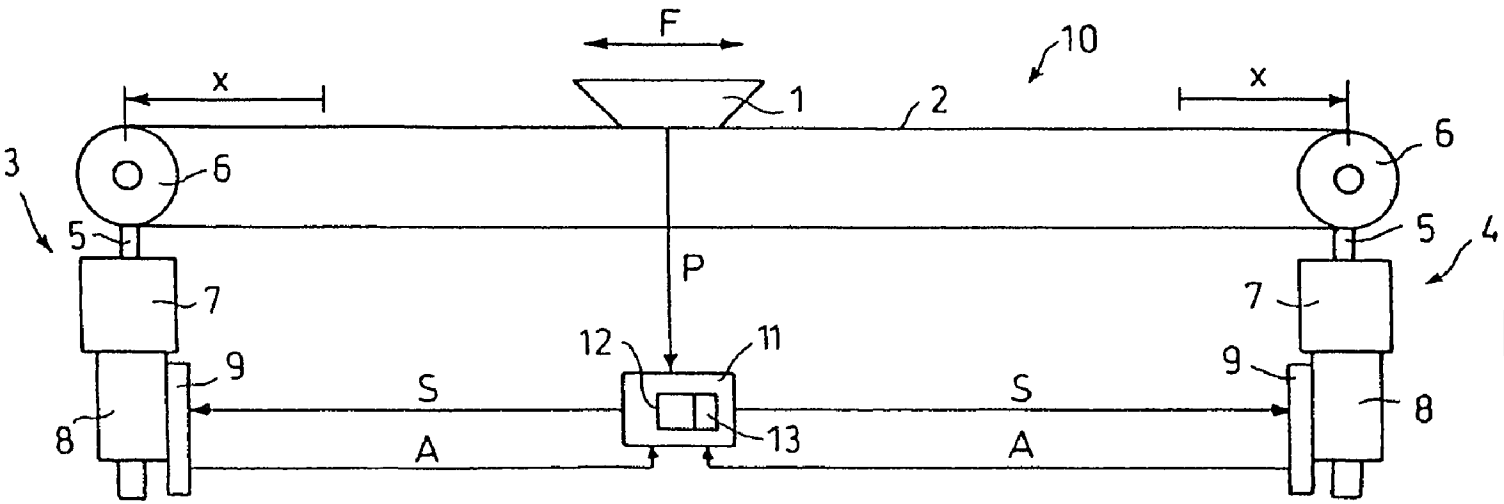

This application claims priority to German Application No. 10 2005 020 170.9 filed on Apr. 28, 2005.

The invention relates to a planing device, with a mining planer reversibly moveable by means of a planer chain and travelable back and forth between planer limit stops, with at least two chain drives having in each case a variable-speed drive motor, a gearing and a planer chain wheel engaged with the chain links of the planer chain, with a planer travel measurement system and with a motor control device which, for example by program control or position control, delivers activation parameters for a change in rotational speed of the drive motors in order to change the planer speed, and which is assigned a control module with automatic load compensation regulation between the drive motors of the chain drives. The invention relates, furthermore, to a method for activating a planing device, in particular a coal planing device for underground mining, with at least two chain drives which have in each case a variable-speed drive motor, a gearing and a planer chain wheel, with a mining planer which is driven by means of the planer chain and which travels back and forth reversibly between planer limit stops during operation, with a planer travel, measurement system which provides planer position signals, and with a motor control device which delivers activation parameters to the drive motors and which is assigned a control module which, in the normal operating mode, automatically effects load compensation between the two drive motors and coordinates the activation parameters of the two drive motors with one another.

A generic planing device is operated in the Ibbenbüren mine and is described in the journal Bergbau [Mining] 7/2003, p. 311-315. The planing device is equipped with standard 400 kW frequency converter motors which, via a professional bus interface, can communicate with one another and with a master longwall mainframe for remote diagnosis. The drive motors of the chain drives can travel in continuous operation at rotational speeds of 80-1800 rev/min., and the motor control device comprises a control module which effects automatic load compensation of the two drive motors driving the planer chain wheels. The planer travel measurement system has planer travel pulse generators in the overload gearings, and the speed of the planer can be regulated continuously at the longwall ends. In this case, the drive motors maintain their maximum torque at the longwall ends. The planing device used in the Ibbenbüren mine makes it possible to achieve high productivity. When the planing device is operating continuously, however, unusually high chain wear occurs separately on a few chain links and on the teeth of the planer chain wheels.

The object of the invention is to provide an improved planing device and a method for operating the planing device, which, while preserving the same productivity and power data of the planing device, prevent the occurrence of excessive chain wear.

This object is achieved, according to the invention, for the planing device, in that a monitoring module is provided, which switches off the control module for load compensation regulation or modifies the operating mode of the control module in a suitable way, for example by position control, program control and/or parameter control. The object is achieved, for the method according to the invention, in that the control module switches off the control module for load compensation regulation or temporarily changes the operating mode of the control module, for example, by position control as a function of the planer position signals and of the running direction of the mining planer, by program control or by parameter control.

Comprehensive investigations of the chain wear on the planer installation in Ibbenbüren have shown that the excessive chain wear is restricted locally to three to five chain links in each case in the length end of that chain length which, when the planer runs into the planer end region of the main drive pulling with regard to the respective planer running direction, is in engagement with the planer chain wheel of the other (auxiliary) chain drive. The applicant attributes the high wear of the planer chain on the corresponding chain links to the high chain tensions which are introduced into the planer chain when the planer motors deploy their maximum torque, even when the planer runs at a reduced planer speed in the planer end region, which can scarcely be avoided in order to avoid damage to, for example, mechanical planer limit stops or the drives.

The problem solution according to the invention is to provide a monitoring module which switches off the control module for load compensation regulation and generates specific activation parameters or modifies the activation parameters transmitted from the control module to the drive motors. In the motor control devices used hitherto for variable-speed drive motors which operate with automatic load compensation regulation, the load compensation regulation is maintained between the main drive and auxiliary drive in all the operating states, in that, for example, the current actual value of one of the motors is transferred, as an activation parameter, to the control of the other motor in each case, and both the main drive and the auxiliary drive receive the same desired rotational speed instruction. Since, at the same time, the planer speed is lowered in the planer end region to sometimes extremely low planer speeds of 1/30 to 1/10 of the normal planer speed, without the control module for load compensation regulation being cut back according to the invention the full drive torque of both chain drives may possibly be introduced into the chain, which may result in extremely high chain tensions in the lower strand of the planer chain, which, even in the case of wire thicknesses of the planer chain of 38 mm or 42 mm, could lead to considerable chain wear and mechanical abrasion on the chain links. By contrast, owing to the measures according to the invention, the problem mentioned no longer arises.

In the method according to the invention, preferably, the monitoring module can compare the drive rotational speed of the (auxiliary) chain drive remote from the planer with a desired rotational speed and, if the desired rotational speed is undershot by the amount of a preset deviation, can deliver the activation parameters for this drive chain remote from the planer according to a specific activation program. It is especially advantageous, if the monitoring module implements the switch-off or cutback of the normal operating mode of the control module both by rotational speed control and by position control, to be precise when the planer travel measurement system detects the mining planer in the planer end region, and then delivers different activation parameters for the two drive motors.

With regard to both the planing device and the method according to the invention, it is especially advantageous if the drive motors consist of frequency converter motors. It is advantageous, further, if the gearings comprise an overload gearing with multiple-disk clutch, so that the planing device according to the invention and the method also, for example, allow a smooth start-up and are provided with overload protection.

The monitoring module and/or the control module may consist, in particular, of software modules for the motor control device. The solution according to the invention can consequently be implemented, where the planing device and the method are concerned, by the provision of additional software or program routines.

As regards the planing device and as regards the method, there may be provision, in particular, for the activation parameters of one drive motor to form the command variables for the control module in a normal operating mode, while, in the modified operating mode of the control module, the monitoring module modifies the activation parameters for the other drive motor proportionally or according to a predetermined algorithm. In the simplest embodiment, it may in this case be sufficient for the monitoring module to regulate the activation parameters for the other drive motor in each case down to a value at which the corresponding drive takes essentially only the load due to the friction of the planer chain in the lower strand of the chain guide, so that, at the same time, the formation of sag at the other chain drive (main drive) is avoided. The monitoring module may, in particular, limit the motor torque of one of the drive motors to a preset value.

The planing device according to the invention and the method according to the invention may operate with a central, if appropriate, above-ground motor control. In the preferred embodiment, each drive motor is assigned a motor control, the motor controls communicating directly with one another via a signal connection, such as a data bus or radio, or being connected to a master motor control device. The modified operating mode may also provide for the respective auxiliary drive to ignore the activation parameters of the other chain drive as soon as the monitoring module acts on the control.

Figure 2:
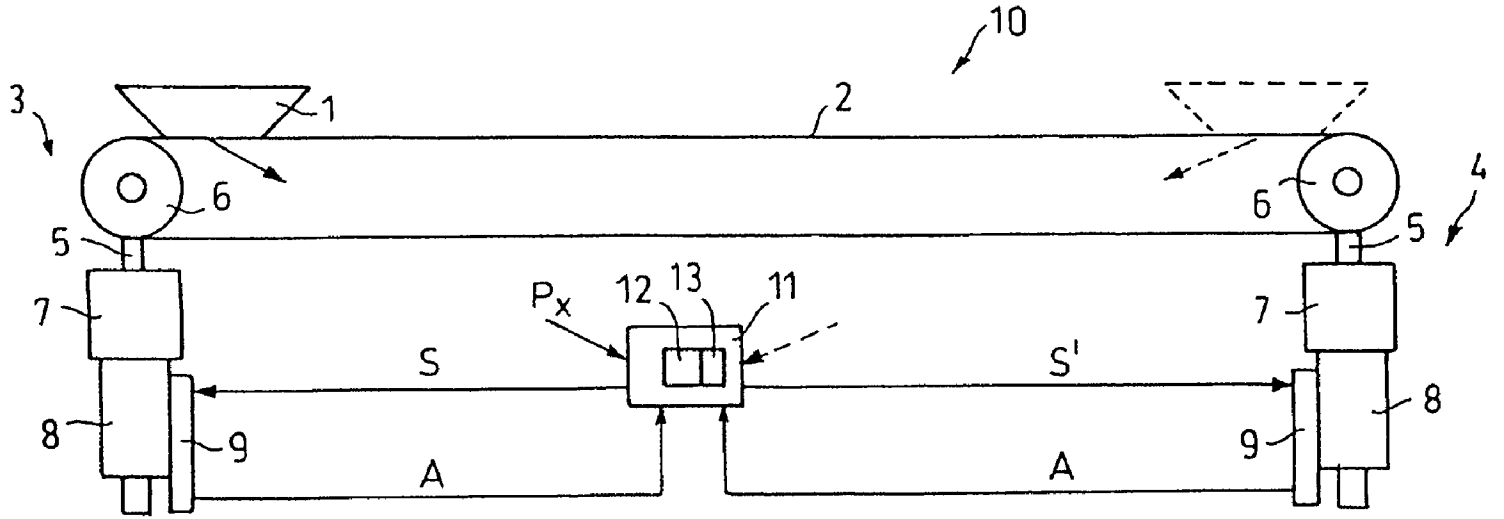

Further advantages and refinements of the invention may also be gathered from the following description of an exemplary embodiment illustrated diagrammatically in the drawing in which:

FIG. 1 shows diagrammatically a planing device according to the invention during planing operation with load compensation; and FIG. 2 shows diagrammatically the planing device according to tile invention in the case of an active monitoring device.

In the figures, reference symbol 10 designates as a whole a planing device according to the invention having a planer 1 which is moved back and forth by means of a planer chain 2 reversibly between the chain drives 3 and 4, arranged at the ends, for the planer chain 2. The reversible movement of the planer 1 is indicated by a double arrow F in FIGS. 1. Both chain drives 3, 4 are, in principle, constructed identically and comprise a chain wheel 6 mounted on a drive shaft 5, a gearing 7 and a drive motor 8 which, in the exemplary embodiment illustrated, is in each case a frequency converter motor with a frequency converter control circuit arranged, for example, in a separate switch box 9. The frequency converter motor 8 can be run in continuous operation variably at rotational speeds over a comparatively wide bandwidth of, for example, 80 to 1800 rev/min., a change in rotational speed of the respective drive chain wheel 6 and consequently also in the traveling speed of the planer 1 being achieved via a change in rotational speed of the drive motors 8. As is known for planer drives in underground mining, both gearings 7 comprise an overload gearing with multiple-disk clutch, which, for example in the event of blockages of the planer chain 2 or of the planer 1, automatically separates the planer drive 8 from the planer chain wheel 6 connected fixedly in terms of rotation to the drive shaft 5.

For the unmanned automatic control of the planing device 10, the figures illustrate a control computer 11 which is provided with a suitable automation software having numerous software modules and is connected, for example via at data bus to the motors 8 for the activation and remote diagnosis of the operating state of the two drive motors 8 of the chain drives 3, 4. A software module in the control computer 11 in this case consists of a motor control, via which the planing speed of the planer 1 is reduced, in the region of the planer limit stops which are illustrated by the arrows X in FIG. 1 and extend over a range of about 0 to 10 meters in front of the respective chain drives 3, 4, to a lower speed as a result of the lowering of the rotational speed of the frequency converter motors 8. The control computer 11 comprises, furthermore, an evaluation unit for a planer position signal P of a planer travel measurement system, not illustrated in detail. In FIGS. 1 and 2, the instantaneous planer position is indicated by an arrow P between the planer 1 and the control computer 11. As a rule, however, the planer position signal P is not generated by the planer 1 itself, but, instead, after an installation travel, the instantaneous planer position signal P is derived from the revolutions of the planer chain wheels 6 and is supplied to the control computer 11. The control computer 11 comprises, furthermore, a control module 12, indicated symbolically here, for load compensation regulation, this control module 12 normally consisting of a further software module. The control module 12 for load compensation checks the current activation data A of the drive motors 8 of the two chain drives 3, 4 for the planer chain 2 and ensures that the same activation parameters S, such as, for example, desired rotational speed, motor current, motor power, etc., are delivered to both drive motors 8 at any time point during the mining travel of the planer 1, so that both chain drives 3, 4 behave identically during the entire operating period. Load compensation by means of the control module 12 may take place, for example, such that the drive motor 8 of the chain drive 3 forms in each case the master motor, the activation data of which are taken over by the other drive motor 8 in each case, which then forms what is known as the slave motor, the exchange of the respective activation parameters either taking place via a control computer 11, as in the exemplary embodiment shown, but alternatively also being capable of taking place by means of a communication of the control circuits of the two drive motors 8 directly with one another. A planing device 10 having the features described above is known in the prior art, in the known planing devices the control module 12 being active for the load compensation at any time point, consequently permanently.

Referring to FIG. 2, then, the critical situation is described when the planer 1 runs, for example, into the planer end region (X, FIG. 1) of the chain drive 3 on the left in FIG. 2 and is located just in front of the motor limit stop, not illustrated, which in most cases will consist of a mechanical motor limit stop, but could also consist of a position signal or the like. The chain drive 3 toward which the planer 1 is drawn via tile planer chain 2 is often designated in the literature as the main drive, while the corresponding other chain drive 4 which draws only the long chain in the lower strand of the planer guide then forms the auxiliary drive. As a result of the reversible activity of the planer 1, however, during each planer travel, the distribution of the main drive and auxiliary drive changes, so that, in modern method control, usually one of the two chain drives forms the master drive and the other chain drive forms the slave drive. If, then, the planer 1 runs into the planer end region designated in FIG. 1 by X, the control computer 11 receives a position signal $P_X$ and, under position control by this control signal, the control computer 11 generates new activation parameters for both drive motors 8 by means of the motor control, in particular the motor desired rotational speed being reduced considerably, as compared with the motor rotational speed in normal planing operation, in order to prevent the planer 1 from running at full speed onto the planer limit stop. In the plainer end region X, however, it is often to be observed that the planer 1 also has to cut support backfills along the belt run and is therefore braked in its speed by additional broken material and other influences. In order nevertheless to have a uniform cutting power and cutting action at a lowered rotational speed, the control computer 11 increases, for example, the motor current delivered as an activation parameter to both drive motors 8, arid consequently the motor torque, while at the same time the load compensation control module 12 of the control computer 11 would ensure the same activation data on the other drive motor 8 of the chain drive 4.

According to the invention, then, the control computer 11 is equipped with a monitoring module 13 which again may consist, in particular, of a software module or of a software routine and which, in particular by position control, that is to say as soon as the planer 1 reaches the longwall end region X or a specific location within the longwall end region X, cancels the action and functioning of the load compensation control module 12. FIG. 2 illustrates the action of the monitoring module 13 with the different activation parameters S for the drive motor 8 of the chain drive 3 and S' for the drive motor 8 of the chain drive 4 (auxiliary or slave drive). The different activation parameters S, S' may behave proportionally to one another, in that, for example, only reduced activation parameters (for example, motor torque, motor current, etc.) are delivered to the drive motor 8 of the slave chain drive 4. However, the monitoring module 13 may also become active when the current rotational speed of the chain wheel 6 of the slave drive 4 lies, sign-corrected, significantly below the desired rotational speed predetermined by the motor control of the control computer 11, the control current input of the control of the slave drive then no longer being predetermined by the actual current output of the drive motor a of the master drive 3, but, instead, being smoothed in relation to the output signal or being cut back to a value predetermined in the monitoring module 13. However, the action of the monitoring module 13 may also be based on many other functions and procedures which readily become apparent to a person skilled in the art from the above description.

The switch-off or modification of the load compensation motor control by the control module 12 prevents the situation where, at a time point shortly before the limit stop is reached and before the reversal of the planer 1, an excessively high chain tension builds up, which takes effect, in particular, in the lower strand of the planer chain 2 and, without the monitoring module 13, could lead to rotary pendulum movements of the planer chain wheel 6 on the respective slave drive 4 and to wear of the chain links of the planer chain 2 which are in engagement with this.

The invention claimed is:

1. A planing device, comprising:

a mining planer reversibly moveable by means of a planer chain and traveling back and forth between planer limit stops, with at least a first chain drive and a second chain drive each having a variable-speed drive motor, a gearing and a chain wheel engaged with chain links of the planer chain, with a planer travel measurement system and with a motor control device which, by at least one of program control or position control, delivers activation parameters for a change in rotational speed of the drive motors for changing the planing speed and which is assigned a control module with automatic load compensation regulation between the drive motors of the chain drives, wherein a monitoring module, by at least one of position control, program control or parameter control, switches off the control module for load compensation regulation or modifies an operating mode of the control module.

2. The planing device of claim 1, wherein the monitoring module, by position control, delivers different activation parameters to the two drive motors when the planer travel measurement system detects the mining planer in a planer end region.

3. The planing device of claim 1, wherein the monitoring module, by parameter control, at least one of deactivates the control module or modifies the operating mode of the control module in the event of undershooting of a rotational speed or rotational speed difference.

4. The planing device of claim 1, wherein each of the drive motors includes at least one frequency converter motor.

5. The planing device of claim 1, wherein each of the gearings includes an overload gearing with multiple-disk clutch.

6. The planing device of claim 1, wherein at least one of the monitoring module or the control module includes software modules for the motor control device.

7. The planing device of claim 1, wherein the activation parameters of one of the drive motors form a command variable for the load compensation control module; and in the modified operating mode of the control module, the monitoring module modifies the activation parameters for another drive motor one of proportionally or according to a predetermined algorithm.

8. The planing device of claim 1, wherein the monitoring module limits a motor torque of one of the drive motors to a predetermined value.

9. The planing device of claim 1, wherein each of the drive motors is assigned a motor control, each motor control communicating directly with one another via at least one of a signal connection or communicating with a master motor control device.

10. A method for activating a planing device for underground mining, including at least a first chain drive and a second chain drive each having a variable-speed drive motor, a gearing and a chain wheel, with a mining planer which is driven by means of a planer chain and which travels back and forth reversibly between planer limit stops during operation, with a planer travel measurement system which provides planer position signals, and with a motor control device which delivers activation parameters to the first and second drive motors, is assigned a control module automatically bringing about load compensation between the first and second drive motors in a normal operating mode, and coordinates activation parameters of the drive motors with one another, wherein a monitoring module switches off the control module for load compensation regulation or temporarily changes the operating mode of the control module by position control as a function of the planer position signals and of a running direction of the mining planer, by program control or by parameter control.

11. The method of claim 10, wherein the monitoring module compares a drive rotational speed of the chain drive remote from the planer with a desired rotational speed and, if the desired rotational speed undershoots a preset deviation, delivers the activation parameters for the chain drive remote from the planer according to a specific activation program.

12. The method of claim 10, wherein the monitoring module delivers different activation parameters for the drive motors by position control when the planer travel measurement system detects the mining planer in a planer end region.

13. The method of claim 10, wherein the monitoring module one of deactivates the control module or modifies the operating mode of the control module by parameter control when a rotational speed or rotational speed difference is undershot.

14. The method of claim 10, wherein at least one of the monitoring module or the control module includes software modules for the motor control device.

15. The method of claim 10, wherein each of the drive motors includes at least one frequency converter motor.

16. The method of claim 10, wherein each of the gearings includes an overload gearing with multiple-disk clutch.

17. The method of claim 10, wherein the activation parameters of one of the drive motors form a command variable for the control module; and in the modified operating mode of the control module, the monitoring module modifies the activation parameters for another drive motor one of proportionally or according to a predetermined algorithm.

18. The method of claim 10, wherein the monitoring module limits the motor torque of one of the drive motors to a predetermined value.

19. The method of claim 10, wherein each of the drive motors is assigned a motor control, each motor control communicating directly with one another via at least one of a signal connection or communicating with a master motor control device.

* * * * *